US008680961B2

(12) United States Patent
Yokota et al.

(10) Patent No.: US 8,680,961 B2
(45) Date of Patent: Mar. 25, 2014

(54) REACTOR AND REACTOR MANUFACTURING METHOD

(75) Inventors: Shuji Yokota, Nagoya (JP); Masaki Sugiyama, Miyoshi (JP); Shinjiro Saigusa, Toyota (JP); Nobuki Shinohara, Miyoshi (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 4 days.

(21) Appl. No.: 13/582,623

(22) PCT Filed: Jun. 22, 2010

(86) PCT No.: PCT/JP2010/060561

§ 371 (c)(1),
(2), (4) Date: Sep. 4, 2012

(87) PCT Pub. No.: WO2011/161769

PCT Pub. Date: Dec. 29, 2011

(65) Prior Publication Data

US 2013/0002384 A1 Jan. 3, 2013

(51) Int. Cl.

| | |
|---|---|
| ***H01F 27/24*** | (2006.01) |
| ***H01F 27/02*** | (2006.01) |
| ***H01F 27/00*** | (2006.01) |
| ***H01F 17/04*** | (2006.01) |
| ***H01F 27/28*** | (2006.01) |
| ***H01F 7/06*** | (2006.01) |

(52) U.S. Cl.
USPC ..... 336/212; 336/83; 336/90; 336/96; 336/221; 336/233; 29/602.1

(58) Field of Classification Search
USPC ..... 336/82–83, 128, 131–132, 145, 90–96, 336/219–222, 199, 212, 178, 208, 233
See application file for complete search history.

(56) References Cited

U.S. PATENT DOCUMENTS 3,028,570 A * 4/1962 Taylor ..... 336/83
3,135,937 A * 6/1964 Habsburg ..... 336/136

(Continued)

FOREIGN PATENT DOCUMENTS

| | | | |
|---|---|---|---|
| JP | 01-287907 | A | 11/1989 |
| JP | 05-226157 | A | 9/1993 |
| JP | 06-089819 | A | 3/1994 |
| JP | 08-321423 | A | 12/1996 |

(Continued)

OTHER PUBLICATIONS

International Search Report of PCT/JP2010/060561 mailed Oct. 5, 2010.

*Primary Examiner* — Elvin G Enad
*Assistant Examiner* — Ronald Hinson
(74) *Attorney, Agent, or Firm* — Kenyon & Kenyon LLP

(57) ABSTRACT

The disclosed reactor has a case and a cylindrical molded coil assembly which is disposed inside of the case and which is formed by covering a coil with a resin, wherein the coil assembly is sealed by an iron powder mixed resin to which iron powder has been admixed. The reactor has a pillar provided as a single body with the case, and one or multiple ring-shaped core members. The ring-shaped core members are disposed outside the outer surface of the pillar such that the pillar is inserted inside the inner surface of said ring-shaped core members, and the assembly coil is disposed outside the outer surface of the ring-shaped core members such that the ring-shaped core members are inserted inside the inner surface of said coil assembly. The ring-shaped core members are sealed by means of the aforementioned iron powder-mixed resin.

17 Claims, 8 Drawing Sheets

(56) References Cited

U.S. PATENT DOCUMENTS

| | | | | |
|---|---|---|---|---|
| 4,507,640 | A * | 3/1985 | Rich et al. | 336/223 |
| 5,214,403 | A * | 5/1993 | Bogaerts et al. | 336/84 C |
| 6,310,533 | B2 * | 10/2001 | Coulombier | 336/90 |
| 6,483,218 | B1 * | 11/2002 | Petrinko | 310/112 |
| 8,461,955 | B2 * | 6/2013 | Yokota | 336/212 |
| 2001/0030594 | A1 | 10/2001 | Abe et al. | |
| 2002/0021199 | A1 * | 2/2002 | Serino et al. | 336/84 M |
| 2007/0052510 | A1 * | 3/2007 | Saegusa et al. | 336/92 |
| 2011/0025444 | A1 * | 2/2011 | Sugiyama et al. | 336/212 |

FOREIGN PATENT DOCUMENTS

| | | | |
|---|---|---|---|
| JP | 2002-203729 | A | 7/2002 |
| JP | 2006-352021 | A | 12/2006 |
| JP | 2008-021948 | a | 1/2008 |
| JP | 2008-091197 | A | 4/2008 |
| JP | 2008-130964 | A | 6/2008 |
| JP | 2009-246221 | A | 10/2009 |
| JP | 2009-259985 | A | 11/2009 |
| JP | 2009-259986 | A | 11/2009 |
| JP | 2010-027692 | A | 2/2010 |
| WO | 2011/161770 | A1 | 12/2011 |

* cited by examiner

REACTOR AND REACTOR MANUFACTURING METHOD

CROSS-REFERENCE TO RELATED APPLICATIONS

This is a 371 national phase application of PCT/JP2010/060561 filed on Jun. 22, 2010, the entire contents of which are incorporated herein by reference.

FIELD OF THE INVENTION

The present invention relates to a reactor used for example in a booster circuit of a motor drive device, and a method of manufacturing the reactor.

BACKGROUND OF THE INVENTION

Reactors are known that are used in booster circuits of motor drive devices of electric vehicles or hybrid electric vehicles. The reactor changes voltage using inductive reactance and is made with a core and a coil. The reactor is used as a part integrated in a switching circuit, and it is repeatedly switched on and off, storing energy in the coil when switched on and creating a counter electromotive force when switched off, thereby outputting a high voltage.

Patent Document 1 discloses a technique for a reactor comprising a coil molded with an iron-resin composite containing iron powder. With this reactor, the iron-resin composite used for molding the coil functions as the core.

RELATED ART DOCUMENTS

Patent Documents

Patent Document 1: JP 2006-352021A

SUMMARY OF THE INVENTION

Problems to be Solved by the Invention

However, with the technique of Patent Document 1, the iron content of the iron-resin composite is low so that the core has a low magnetic permeability. To achieve a necessary inductance, the volume of the iron-resin composite needs to be made large to increase the cross-sectional area of the core. This results in a large outer shape of the reactor.

One possibility is to adjust the number of windings of the coil and the volume of the iron-resin composite to adjust the inductance. However, when the reactor is to be mounted within a limited area of, for example, a booster circuit of a motor drive device, there are limitations on the number of windings of the coil or the volume of the iron-resin composite, because of which there may be a case where the inductance cannot be adjusted to a necessary level. This means that the reactor cannot be provided with characteristics that keep the inductance changes sufficiently small irrespective of large current changes, i.e., stable DC superimposition characteristics showing a substantially constant (flat) inductance within the range of current being used. That is, the reactor has poor performance.

The material cost of the iron-resin composite is high, and the composite requires a long time to set. Therefore, a large amount of filling iron-resin composite leads to a higher production cost of the reactor.

Moreover, the coil is prone to come off of a predetermined position unless the coil is retained by some means when the inside of the case is filled with the iron-resin composite as in the technique of Patent Document 1, which causes a reduction in the productivity of the reactor.

Accordingly, the present invention has been made to solve the above problems and has a purpose to provide a reactor and a reactor manufacturing method enabling to reduce the size of the outer shape of the reactor and to enhance the performance of the reactor.

Means of Solving the Problems

One aspect of the present invention to solve the above problems is a reactor having a case and a cylindrical coil assembly stored in the case and formed to have a coil covered with resin, an iron-resin composite containing iron powder for sealing the coil assembly, wherein the reactor comprises a pillar integrally formed with the case and one or a plurality of ring-shaped core members, the ring-shaped core member or members are provided outside an outer peripheral surface of the pillar such that the pillar is inserted inside an inner peripheral surface of the ring-shaped core member or members, the coil assembly is provided outside an outer peripheral surface of the ring-shaped core member or members such that the ring-shaped core member or members are inserted inside an inner peripheral surface of the coil assembly, the ring-shaped core member or members are sealed with the iron-resin composite, the reactor includes a bobbin having an opening formed with an end surface and a side wall extending vertically from a peripheral edge of the end surface, the bobbin is provided inside an inner peripheral surface of the coil assembly so as to cover the ring-shaped core member or members, the bobbin has a flange on an opening end portion of the bobbin, and an axial end face of the coil assembly is in contact with the flange.

According to this aspect, in addition to the iron-resin composite sealing the coil assembly, the reactor comprises the ring-shaped core member(s), so that magnetic property is enhanced. Thereby, large inductance can be obtained even if the volume of the resin core formed by the iron-resin composite is small. This leads to reduction in size of the outer shape of the reactor. Further, the pillar integrally formed with the case is inserted inside the inner peripheral surface of the ring-shaped core member(s), so that the ring-shaped core member(s) can be easily mounted on the case as aligning relative positions of the case and the ring-shaped core member(s) in the axial direction, thus enhancing the productivity of the reactor.

The ring-shaped core member(s) is sealed with the iron-resin composite, thus preventing corrosion and cracks of the ring-shaped core member(s).

Further, the volume of the iron-resin composite can be reduced by the volume of the ring-shaped core member(s), so that time to fill and set the iron-resin composite is shortened. Since the amount of the iron-resin composite to be used is thus reduced, material cost can be reduced. Accordingly, manufacturing cost can be reduced.

Further, the axial end face of the coil assembly is in contact with the flange of the bobbin, so that the axially relative positions of the bobbin and the coil assembly are decided. Therefore, the coil assembly can be placed at a predetermined position while the iron-resin composite is filled and set in the case.

Also, own weight of the coil assembly acts on the ring-shaped core member(s) via the bobbin. Thereby, float and misalignment of the ring-shaped core member(s) can be prevented and the ring-shaped core member(s) can be placed at a predetermined position while the iron-resin composite is filled and set in the case.

In the above aspect, preferably, the reactor includes a seat formed between the pillar and the case, the seat having a larger diameter than that of the pillar, and an axial end face of the ring-shaped core member or members is in contact with the seat.

According to this aspect, the axial end face of the ring-shaped core member(s) is in contact with the seat, so that the axially relative positions of the case and the ring-shaped core member(s) are decided. Therefore, the ring-shaped core member(s) can be placed at a predetermined position without increasing number of components.

In the above aspect, preferably, the bobbin has an opening on at least one of the end surface and the side wall.

According to this aspect, when the iron-resin composite is filled inside the case, the iron-resin composite can be certainly filled in the surroundings of the ring-shaped core member(s) since the iron-resin composite flows inside an inner peripheral surface of the bobbin from the opening thereof.

In a case that a non-magnetic gap plate is provided between the adjacent ring-shaped core members, the ring-shaped core members and the gap plate are securely bonded by the iron-resin composite flowing inside the inner peripheral surface of the bobbin from the opening thereof.

In the above aspect, preferably, the reactor has a non-magnetic gap plate formed into a ring-like shape, and the gap plate is provided in between the adjacent ring-shaped core members.

According to this aspect, inductance can be adjusted by varying thickness and number of the gap plates, so that stable DC superimposition characteristics can be obtained as the inductance is almost at a fixed value (flat) within the used current range. Thereby, performance of the reactor is enhanced.

In the above aspect, preferably, the gap plate has a slit extending from an inner peripheral surface to an outer peripheral surface of an axial end face of the gap plate.

According to this aspect, the iron-resin composite filled inside the case flows into a space between the ring-shaped core members and the gap plate via the slit, so that the ring-shaped core members and the gap plate are securely bonded.

Another aspect of the present invention to solve the above problem is a method of manufacturing a reactor including a case and a cylindrical coil assembly stored inside the case and formed to have a coil covered with resin, an iron-resin composite containing iron powder for sealing the coil assembly, wherein the reactor comprises a pillar integrally formed with the case and one or a plurality of ring-shaped core member or members, the method includes the steps of: placing the ring-shaped core member or members outside an outer peripheral surface of the pillar such that the pillar is inserted inside an inner peripheral surface of the ring-shaped core member or members; covering the ring-shaped core member or members inside an inner peripheral surface of the coil assembly with a bobbin having an opening formed with an end surface and a side wall extending vertically from a peripheral edge of the end surface; placing the coil assembly outside an outer peripheral surface of the bobbin such that the bobbin is inserted inside an inner peripheral surface of the coil assembly; bringing an axial end face of the coil assembly into contact with a flange formed on an opening end portion of the bobbin, and sealing the ring-shaped core member or members with the iron-resin composite.

According to this aspect, the pillar integrally formed with the case is inserted inside the inner peripheral surface of the ring-shaped core member(s), thereby the ring-shaped core member(s) can be easily mounted on the case as aligning the relative positions of the case and the ring-shaped core member(s) in the radial direction. Thereby, the productivity of the reactor is enhanced.

Further, the axial end face of the coil assembly is brought into contact with the flange of the bobbin, so that the axially relative positions of the bobbin and the coil assembly are decided. Therefore, the coil assembly can be placed at a predetermined position while the iron-resin composite is filled and set in the case.

Also, own weight of the coil assembly acts on the ring-shaped core member(s) via the bobbin. Thereby, float and misalignment of the ring-shaped core member can be prevented and the ring-shaped core member(s) can be placed at a predetermined position while the iron-resin composite is filled and set in the case.

In the above aspect, preferably, the method comprises the step of bringing a seat into contact with an axial end face of the ring-shaped core member or members, the seat being formed between the pillar and the case and having a larger diameter than that of the pillar.

According to this aspect, the axial end face of the ring-shaped core member(s) is brought into contact with the seat, so that the axially relative positions of the case and the ring-shaped core member(s) are decided. Therefore, the ring-shaped core member(s) can be placed at a predetermined position without increasing number of components.

In the above aspect, preferably, the bobbin has an opening on at least one of the end surface and the side wall.

According to this aspect, when the iron-resin composite is filled inside the case, the iron-resin composite can be certainly filled in the surroundings of the ring-shaped core member(s) since the iron-resin composite flows inside the inner peripheral surface of the bobbin from the opening thereof.

In a case that a non-magnetic gap plate is provided between the adjacent ring-shaped core members, the ring-shaped core members and the gap plate are securely bonded by the iron-resin composite flowing inside the inner peripheral surface of the bobbin from the opening thereof.

In the above aspect, preferably, a non-magnetic gap plate formed into a ring-like shape is provided between the adjacent ring-shaped core members.

According to this aspect, inductance can be adjusted by varying thickness and number of the gap plates, so that stable DC superimposition characteristics can be obtained as the inductance is almost at a fixed value (flat) within the used current range. Thereby, performance of the reactor is enhanced.

In the above aspect, preferably, the gap plate has a slit extending from an inner peripheral surface to an outer peripheral surface on an axial end face of the gap plate.

According to this aspect, the iron-resin composite filled inside the case flows into the space between the ring-shaped core members and the gap plate via the slit, so that the ring-shaped core members and the gap plate are securely bonded.

Effects of the Invention

Reactor and reactor manufacturing method according to the present invention enable size reduction of the outer shape of the reactor and enhance the performance of the reactor.

DETAILED DESCRIPTION

Embodiments of the present invention will be hereinafter described in detail with reference to the accompanying drawings.

The reactor according to this embodiment is mounted in a drive control system of a hybrid electric vehicle for the purpose of boosting a battery voltage to a level applied to a motor generator.

Therefore, the structure of the drive control system will be described first, after which the reactor according to this embodiment will be described.

First, the drive control system will be described referring to FIG. 1 and FIG. 2.

Figure 1:
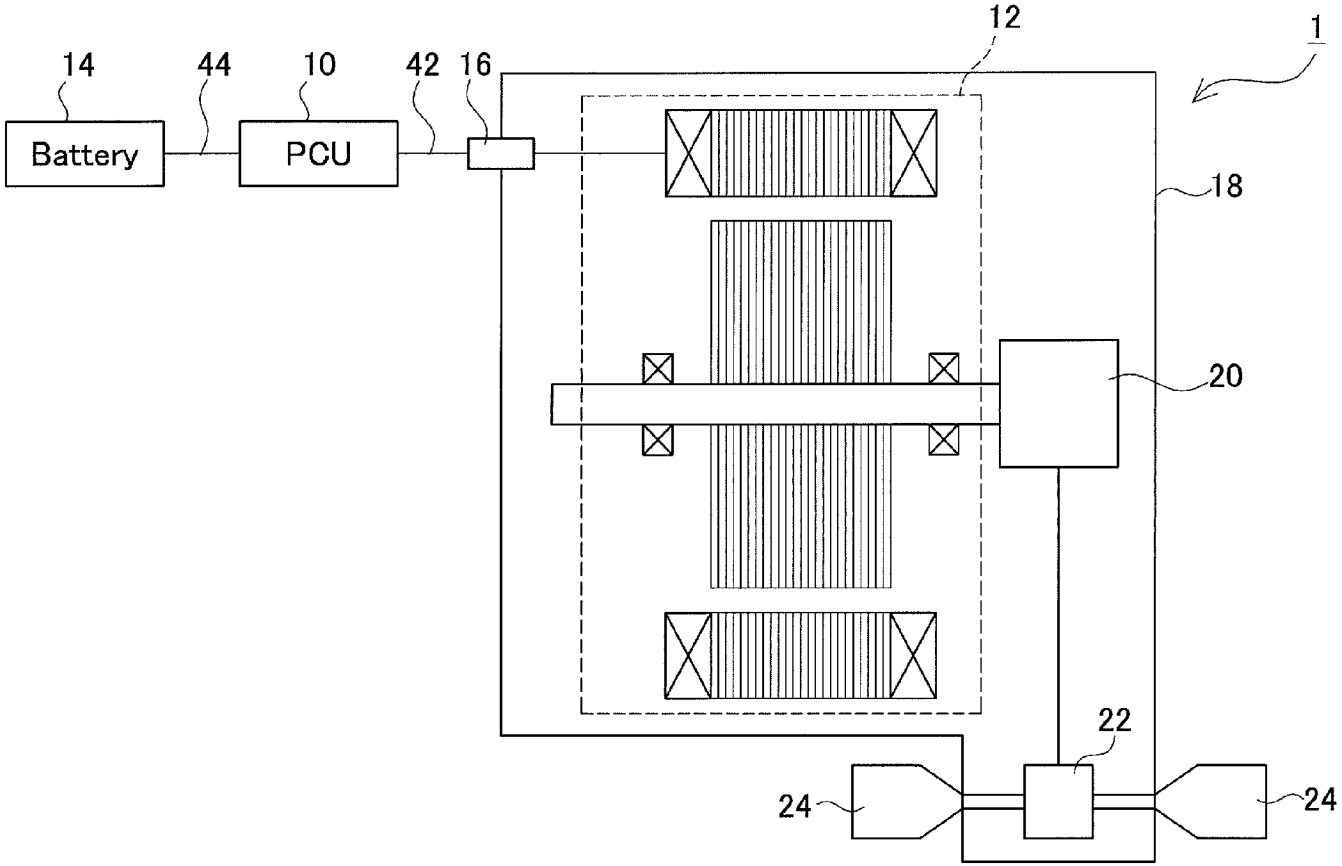
FIG. 1 is a schematic diagram showing one example of a drive control system configuration including a reactor according to a present embodiment.

FIG. 1 is a schematic diagram illustrating one example of a drive control system configuration including the reactor according to this embodiment. FIG. 2 is a circuit diagram illustrating major parts of PCU in FIG. 1.

A drive control system 1 is formed by a PCU (Power Control Unit) 10, a motor generator 12, a battery 14, a terminal base 16, a housing 18, a reduction gear 20, a differential gear 22, drive shaft receiving parts 24, and others as shown in FIG. 1.

Figure 2:
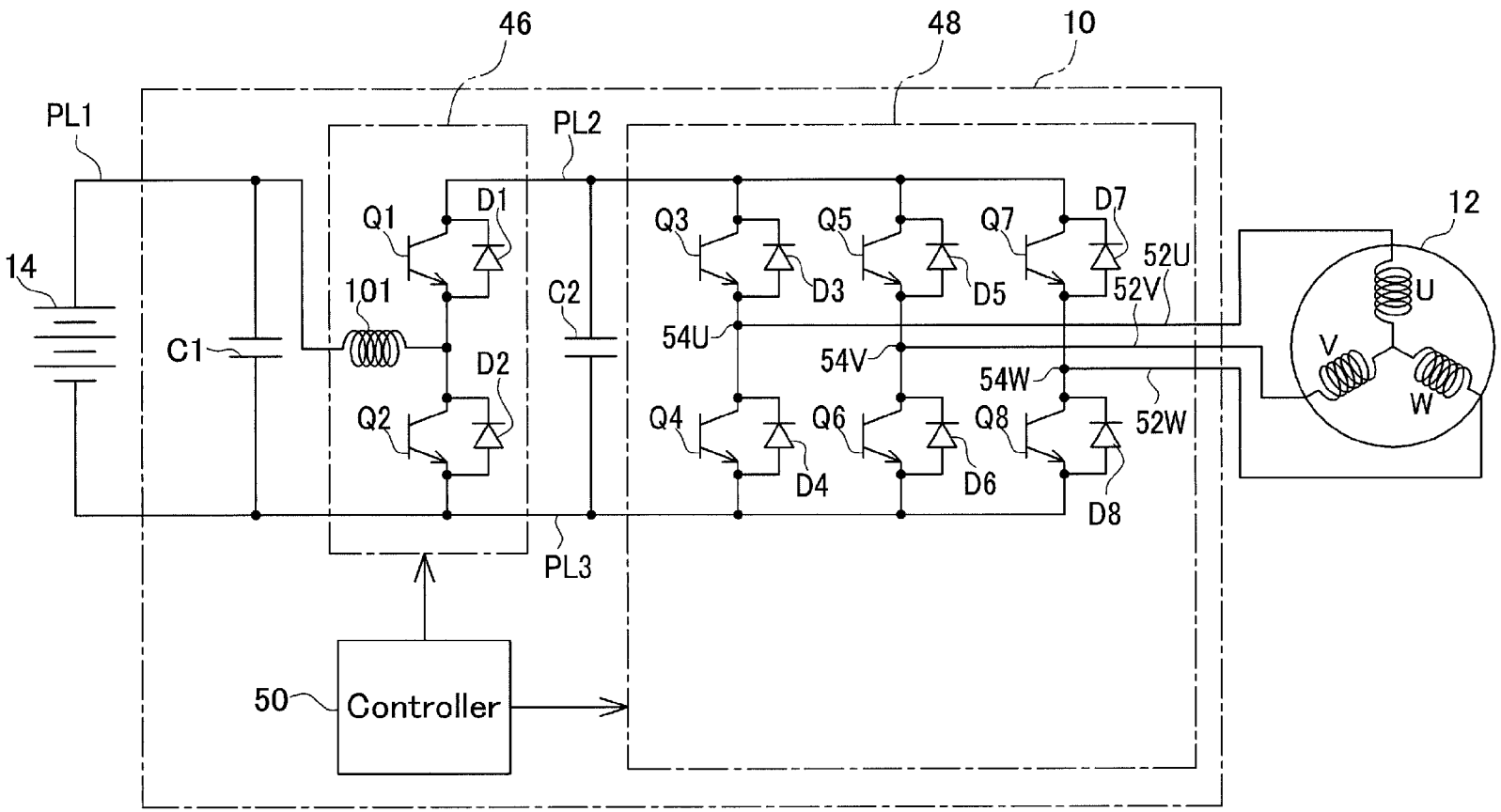
FIG. 2 is a circuit diagram showing major parts of PCU in FIG. 1.

The PCU 10 includes a converter 46, an inverter 48, a controller 50, capacitors C1 and C2, and output lines 52U, 52V, and 52W as shown in FIG. 2.

The converter 46 is connected between the battery 14 and the inverter 48 electrically in parallel with the inverter 48. The inverter 48 is connected to the motor generator 12 via the output lines 52U, 52V, and 52W.

The battery 14 is, for example, a secondary battery such as a nickel metal hydride or lithium ion battery. The battery 14 supplies a direct current to the converter 46 and is charged by the direct current flowing from the converter 46.

The converter 46 is made up of power transistors Q1 and Q2, diodes D1 and D2, and the reactor 101 to be described later in more detail. The power transistors Q1 and Q2 are connected in series between power supply lines PL2 and PL3 and supply control signals from the controller 50 to a base. The diodes D1 and D2 are each connected between collector and emitter terminals of the power transistors Q1 and Q2 so that the current flows from the emitter terminals to the collector terminals of the respective power transistors Q1 and Q2.

The reactor 101 is arranged to have one end connected to a power supply line PL1 that connects to a positive electrode of the battery 14 and the other end connected to a connection point between the power transistors Q1 and Q2.

The converter 46 boosts the DC voltage of the battery 14 by the reactor 101 and supplies the boosted DC voltage to the power supply line PL2. The converter 46 charges the battery 14 with the direct current received from the inverter 48 at a lowered voltage.

The inverter 48 is formed by a U-phase arm 54U, a V-phase arm 54V, and a W-phase arm 54W. The respective phase arms 54U, 54V, and 54W are connected in parallel between the power supply lines PL2 and PL3. The U-phase arm 54U is formed by series-connected power transistors Q3 and Q4, the V-phase arm 54V is formed by series-connected power transistors Q5 and Q6, and the W-phase arm 54W is formed by series-connected power transistors Q7 and Q8. The diodes D3 to D8 are each connected between the collector and emitter terminals of the power transistors Q3 to Q8 so that the current flows from the emitter terminals to the collector terminals of the respective power transistors Q3 to Q8. The connection points between the respective pairs of power transistors Q3 to Q8 at the respective phase arms 54U, 54V, and 54W are connected to the opposite side of the neutral point of the U-phase, V-phase, and W-phase of the motor generator 12, respectively, via the output lines 52U, 52V, and 52W.

The inverter 48 converts a direct current flowing in the power supply line PL2 into an alternating current based on a control signal from the controller 50 and outputs the alternating current to the motor generator 12. The inverter 48 rectifies the alternating current generated by the motor generator 12 and converts the alternating current into a direct current, and supplies the converted direct current to the power supply line PL2.

The capacitor C1 is connected between the power supply lines PL1 and PL3 and smoothes the voltage level of the power supply line PL1. The capacitor C2 is connected between the power supply lines PL2 and PL3 and smoothes the voltage level of the power supply line PL2.

The controller 50 calculates the coil voltages at the U-phase, V-phase, and W-phase of the motor generator 12 based on the rotation angle of a rotor of the motor generator 12, motor torque commands, current values at the U-phase, V-phase, and W-phase of the motor generator 12, and an input voltage of the inverter 48. The controller 50 generates a PWM (Pulse Width Modulation) signal for switching on and off the power transistors Q3 to Q8 based on the calculation results and outputs the signal to the inverter 48.

Also, in order to optimize the input voltage of the inverter 48, the controller 50 calculates the duty ratio between the power transistors Q1 and Q2 based on the motor torque commands mentioned above and the motor rpm, generates a PWM signal for switching on and off the power transistors Q1 and Q2 based on the calculation results, and outputs the signal to the converter 46.

Further, the controller 50 controls the switching operation of the power transistors Q1 to Q8 in the converter 46 and the inverter 48 for converting the alternating current generated by the motor generator 12 into a direct current to charge the battery 14.

In the PCU 10 configured as described above, the converter 46 boosts the voltage of the battery 14 based on the control signal of the controller 50 and applies the boosted voltage to the power supply line PL2. The capacitor C1 smoothes the voltage applied to the power supply line PL2 and the inverter 48 converts the DC voltage smoothed by the capacitor C1 into an AC voltage and outputs the voltage to the motor generator 12.

On the other hand, the inverter 48 converts the AC voltage generated through regeneration using the motor generator 12 into a DC voltage and outputs the voltage to the power supply line PL2. The capacitor C2 smoothes the voltage applied to the power supply line PL2 and the converter 46 charges the battery 14 with the DC voltage smoothed by the capacitor C2 at a lowered voltage level.

Embodiment 1

Next, the reactor according to the present embodiment will be described.

<Description of the Structure of the Reactor>

Figure 3:
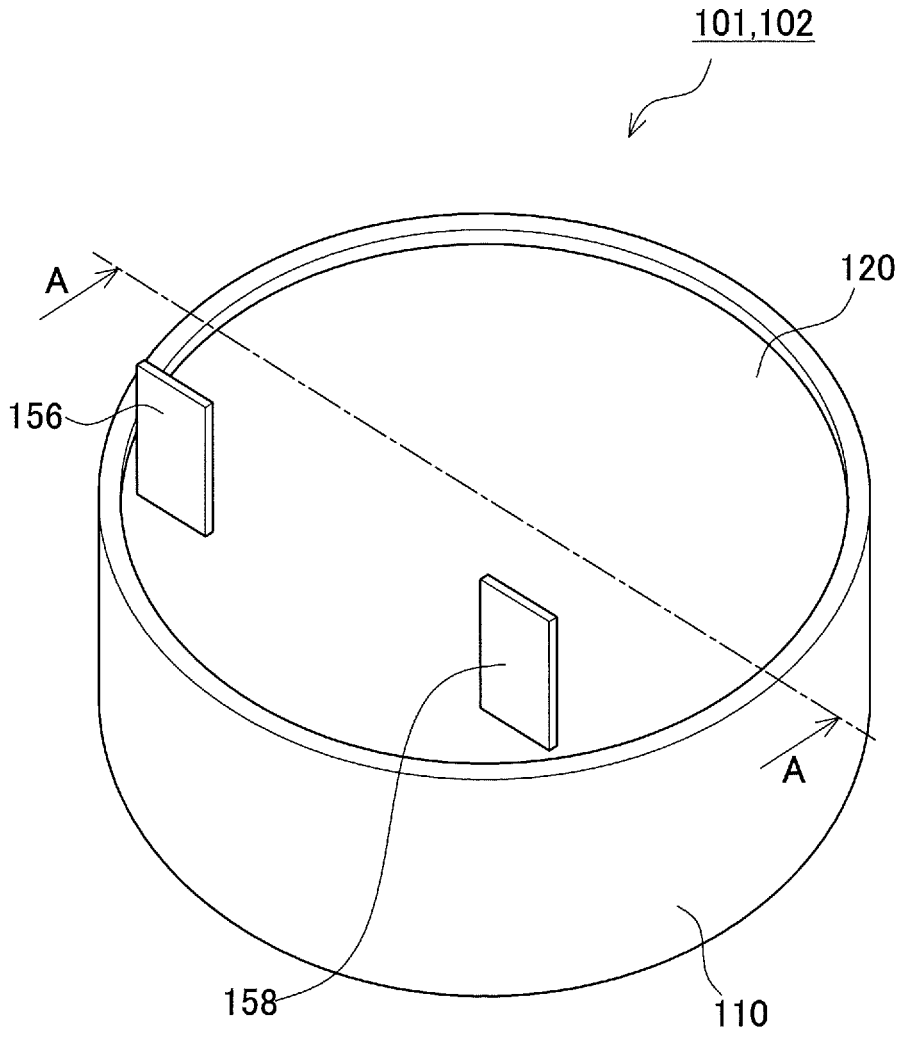
FIG. 3 is an external perspective view of the reactor according to first and second embodiments.
Figure 4:
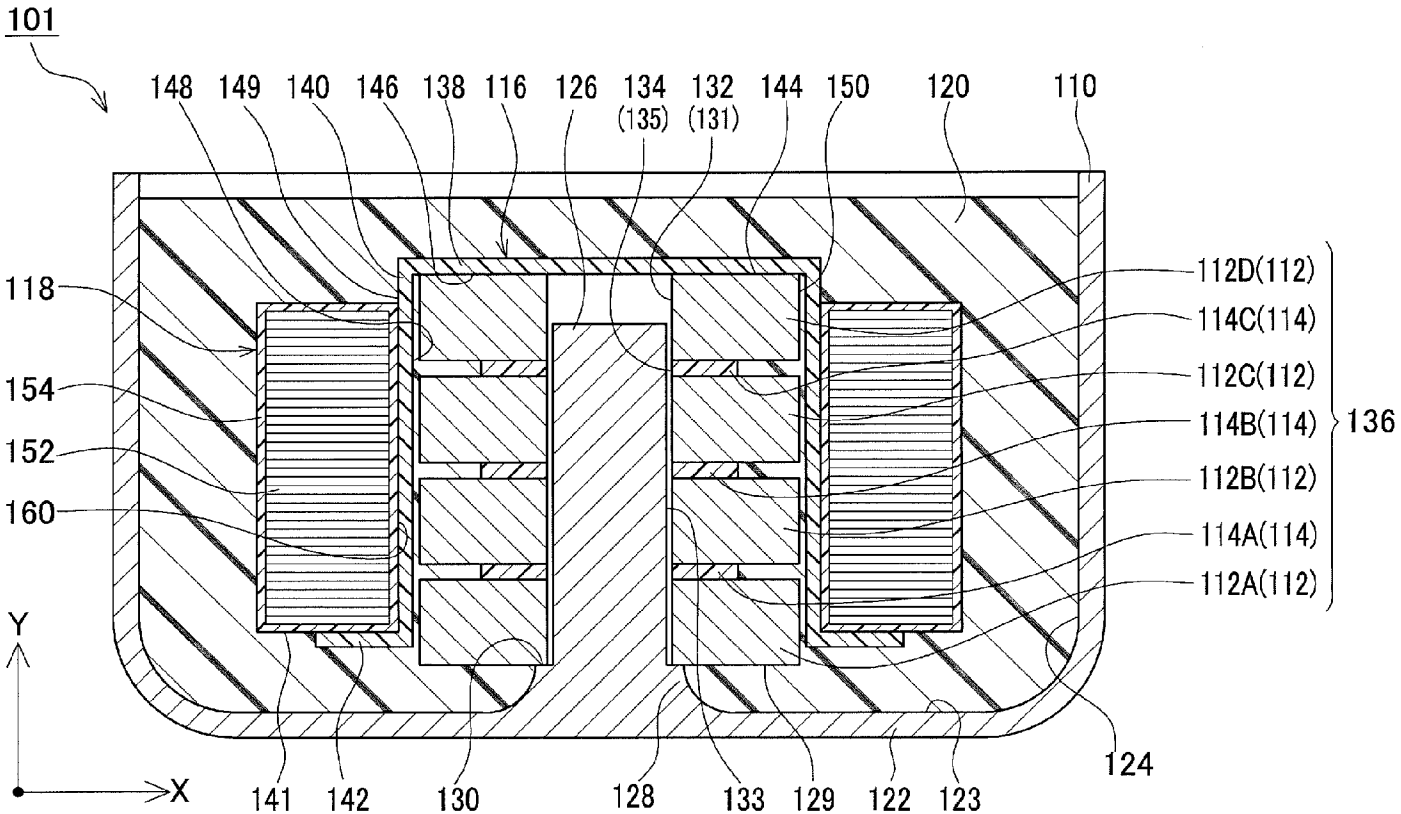
FIG. 4 is a sectional view taken along a line A-A in FIG. 3.
Figure 5:
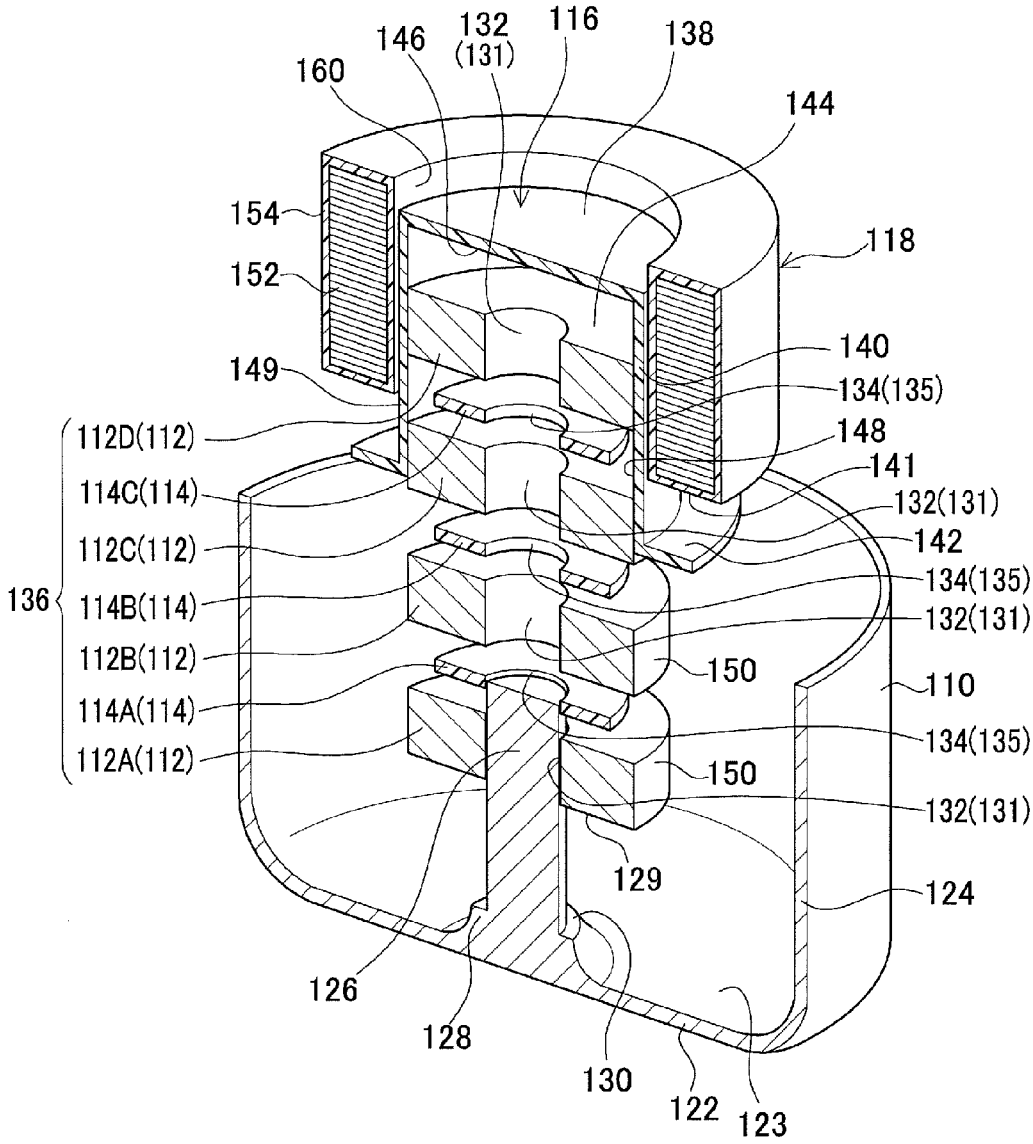
FIG. 5 is an explanatory view explaining how various components configuring the reactor are assembled in a case according to the first embodiment.

FIG. 3 is an external perspective view of the reactor 101 of Embodiment 1, FIG. 4 is a cross sectional view taken along a line A-A in FIG. 3. FIG. 5 is an explanatory view explaining how various components configuring the reactor 101 of this embodiment are mounted on a case 110. Note that, in the following description, a "radial direction" shall refer to the X direction in FIG. 4, while an "axial direction" shall refer to the Y-direction in FIG. 4.

The reactor 102 according to Embodiment 2 to be described later has the same outer shape as the reactor 101 of this embodiment as shown in FIG. 3. As shown in FIGS. 3 and 4, the reactor 101 of this embodiment includes the case 110, pressed powder core members 112, gap plates 114, a bobbin 116, a coil assembly 118, a resin core 120, and so on.

The case 110 is made by casting from aluminum. The case 110 is formed in an open-end box-like shape with a circular bottom part 122 and a side wall 124 provided extending vertically from a peripheral edge of the bottom part 122 as shown in FIG. 5. At a central portion in an inner face 123 of the bottom part 122 is provided with a pillar 126 via a seat 128. The pillar 126 may be either of solid cylindrical shape or hollow cylindrical shape. The pillar 126 is thus formed integrally with the case 110, with the seat 128 provided at a base portion of the pillar 126. An upper face 130 of the seat 128, which is the surface on which the pillar 126 is provided, has a larger diameter than that of the pillar 126. As shown in FIG. 4, an end face 129 on a lower side in an axial direction (the bottom part 122 side of the case 110) of a pressed powder core member 112A is in contact with the seat 128.

The pressed powder core member 112 is a high density magnetic composite (HDMC) made by press-forming magnetic powder with a high density, and formed into a circular ring-like shape. The pressed powder core member 112 has a through hole 132 extending in the axial direction radially inside an inner peripheral surface 131 thereof. The pressed powder core member 112 is provided radially outside an outer peripheral surface 133 of the pillar 126 such that the pillar 126 is inserted into the through hole 132. The pressed powder core member 112 is sealed with an iron-resin composite that forms the resin core 120. In this embodiment, there are four pressed powder core members 112, which are denoted at 112A to 112D in the drawings. The pressed powder core members 112 are provided such as to be spaced apart a certain distance from each other in the axial direction by means of gap plates 114 interposed between the adjacent pressed powder core members 112. The pressed powder core members 112A to 112D are one example of the "ring-shaped core member" of the present invention.

The gap plate 114 is a plate formed of a non-magnetic material and formed into a circular ring-like shape. The gap plate 114 has a through hole 134 extending in the axial direction radially inside an inner peripheral surface 135 thereof. To give one example, the gap plate 114 may be made of alumina ceramics. In this embodiment, there are three gap plates 114, which are denoted at 114A, 114B, and 114C in the drawings. The inductance of the reactor 101 can be adjusted by adjusting the thickness of the gap plates 114A to 114C. The inductance of the reactor 101 can also be adjusted by adjusting the numbers of the pressed powder core members 112 and the gap plates 114.

The pressed powder core members 112 and the gap plates 114 are provided alternately in the axial direction radially outside the outer peripheral surface 133 of the pillar 126 such that the pillar 126 integral with the case 110 is inserted into the through holes 132 of the pressed powder core members 112A to 112D and the through holes 134 of the gap plates 114A to 114C. More specifically, the pressed powder core member 112A, gap plate 114A, pressed powder core member 112B, gap plate 114B, pressed powder core member 112C, gap plate 114C, and pressed powder core member 112D are provided in this order from the bottom part 122 side of the case 110. In this manner, the pressed powder core member 112A located closest to the bottom part 122 of the case 110 is disposed upon the upper face 130 of the seat 128. The plurality of pressed powder core members 112A to 112D are stacked upon one another with the gap plates 114A to 114C interposed in between in this manner to form a tubular center core 136, which is disposed upon the upper face 130 of the seat 128.

The bobbin 116 is formed in an open-end box-like shape with a circular end surface 138 and a side wall 140 extending vertically from a peripheral edge of the end surface 138 (extending downward in FIG. 4). At an opening end portion, the bobbin 116 is formed with a flange 142 of annular shape. Herein, an end face 141 in the axial direction of the coil assembly 118 is in contact with the flange 142. The bobbin 116 may be preferably made of resin with thermal resistance and high electric insulation, such as polyphenylene sulfide resin (PPS).

The bobbin 116 is provided radially inside an inner peripheral surface 160 of the coil assembly 118 so as to cover the center core 136 from an end face 144 side on an upper side of the pressed powder core member 112D. An inner side surface 146 of the end surface 138 of the bobbin 116 is in contact with the end face 144 of the pressed powder core member 112D located uppermost of the center core 136. Further, the inner peripheral surface 148 of the bobbin 116 has a larger diameter than that of the pressed powder core members 112A to 112D. Thereby, there is a space created between the inner peripheral surface 148 of the bobbin 116 and outer peripheral surfaces 150 of the pressed powder core members 112A to 112D, and the iron-resin composite is filled in this space.

The coil assembly 118 is formed of cylindrical shape and includes an edgewise coil 152 and a resin film 154. The edgewise coil 152 is covered by the resin film 154 except for end portions 156 and 158 that will form electrode terminals. Thus, the edgewise coil 152 is insulated from outside except for the end portions 156 and 158. The resin forming the resin film 154 should preferably be a thermosetting resin having high heat resistance such as an epoxy resin. The coil assembly 118 is sealed with the iron-resin composite forming the resin core 120. This coil assembly 118 is provided radially outside the outer peripheral surfaces 150 of the pressed powder core members 112A to 112D such that the pressed powder core members 112A to 112D are inserted radially inside the inner peripheral surface 160 of the coil assembly 118.

The coil assembly 118 is assembled to the bobbin 116 such that the bobbin 116 is inserted radially inside the inner peripheral surface 160. Thus, the relative positions of the bobbin 116 and the coil assembly 118 in the radial direction are determined. Further, the pressed powder core members 112A to 112D, the bobbin 116, and the coil assembly 118 are coaxially placed with ease as guided by the pillar 126. Herein, the coaxial placement of the pressed powder core members 112A to 112D, the bobbin 116, and the coil assembly 118 means that each center axis of the pressed powder core members 112A to 112D, the bobbin 116, and the coil assembly 118 is linearly located on the same position.

The resin core 120 which is formed of the iron-resin composite filled and set in the case 110, seals the pressed powder core members 112A to 112D, the bobbin 116, and the coil assembly 118. The resin core 120 is also provided in the space between the inner peripheral surface 148 of the bobbin 116 and the outer peripheral surfaces 150 of the pressed powder core members 112A to 112D. The iron-resin composite may be preferably a thermosetting resin having high thermal resistance and high thermal conductivity such as an epoxy resin mixed with iron powder.

The reactor 101 of this embodiment includes the resin core 120 formed by filling up the iron-resin composite in the case 110 and the pressed powder core members 112A to 112D having a high magnetic permeability at the center core 136. Therefore, the reactor 101 of this embodiment can provide a large inductance despite the small volume of the resin core 120 due to the magnetic properties being improved while the reactor 101 maintains the characteristics that the resin core 120 allows high freedom of outer shape designing. Accordingly, the reactor 101 of this embodiment can have a smaller outer shape.

Furthermore, the pillar 126 is inserted in the through holes 132 of the pressed powder core members 112A to 112D and the through holes 134 of the gap plates 114A to 114C, so that the pressed powder core members 112A to 112D and the gap plates 114A to 114C can be easily mounted on the case 110 as adjusting the radially relative positions of the case 110 and the pressed powder core members 112A to 112D and the positions of the case 110 and the gap plates 114A to 114C. Thus, the productivity of the reactor 101 is enhanced.

Moreover, since the pressed powder core members 112A to 112D are entirely sealed with the rigid resin core 120, the pressed powder core members 112A to 112D are protected from corrosion and prevented from cracks.

The volume of the resin core 120 is reduced by the volumes of the pressed powder core members 112A to 112D, so that the time required for filling and setting the iron-resin composite to form the resin core 120 is shortened. Also, the amount of use of the iron-resin composite can be reduced, so that the material cost can be reduced. Accordingly, the production cost can be reduced.

The end face 129 of the pressed powder core member 112A is in contact with the seat 128, and the pressed powder core members 112B to 112D and the gap plates 114A to 114C are placed above this pressed powder core member 112A, thus determining the axially relative positions of the case 110, the pressed powder core members 112A to 112D, and the gap plates 114A to 114C. Therefore, the pressed powder core members 112A to 112D can be placed at predetermined positions without increasing number of components.

Further, the inner side surface 146 of the end surface 138 of the bobbin 116 is in contact with the end face 144 of the pressed powder core member 112D placed uppermost of the center core 136, so that the axially relative positions of the pressed powder core members 112A to 112D, the gap plates 114A to 114C, and the bobbin 116 are decided. As a result, the bobbin 116 can be placed at a predetermined position.

The end face 141 of the coil assembly 118 is in contact with the flange 142 of the bobbin 116, so that the axially relative positions of the bobbin 116 and the coil assembly 118 are decided. Therefore, the coil assembly 118 can be placed at a predetermined position while the iron-resin composite is filled and set in the case 110.

Further, own weight of the coil assembly 118 acts on the pressed powder core members 112A to 112D via the bobbin 116. Thereby, the pressed powder core members 112A to 112D can be prevented from float and misalignment and placed at predetermined positions while the iron-resin composite is filled and set in the case 110.

With the non-magnetic gap plates 114 inserted between the adjacent pressed powder core members 112, the distance between the adjacent pressed powder core members 112 can be maintained. Therefore, the magnetic performance is improved, as magnetic flux density saturation is prevented when a large current is applied to the coil.

Also, since the inductance can be readily adjusted by adjusting the thickness or number of the pressed powder core members 112 and the gap plates 114, stable DC superimposition characteristics can be achieved, with the inductance being substantially constant (flat) within the range of current being used, leading to improved performance of the reactor 101.

<Description of the Reactor Manufacturing Method>

Figure 6:
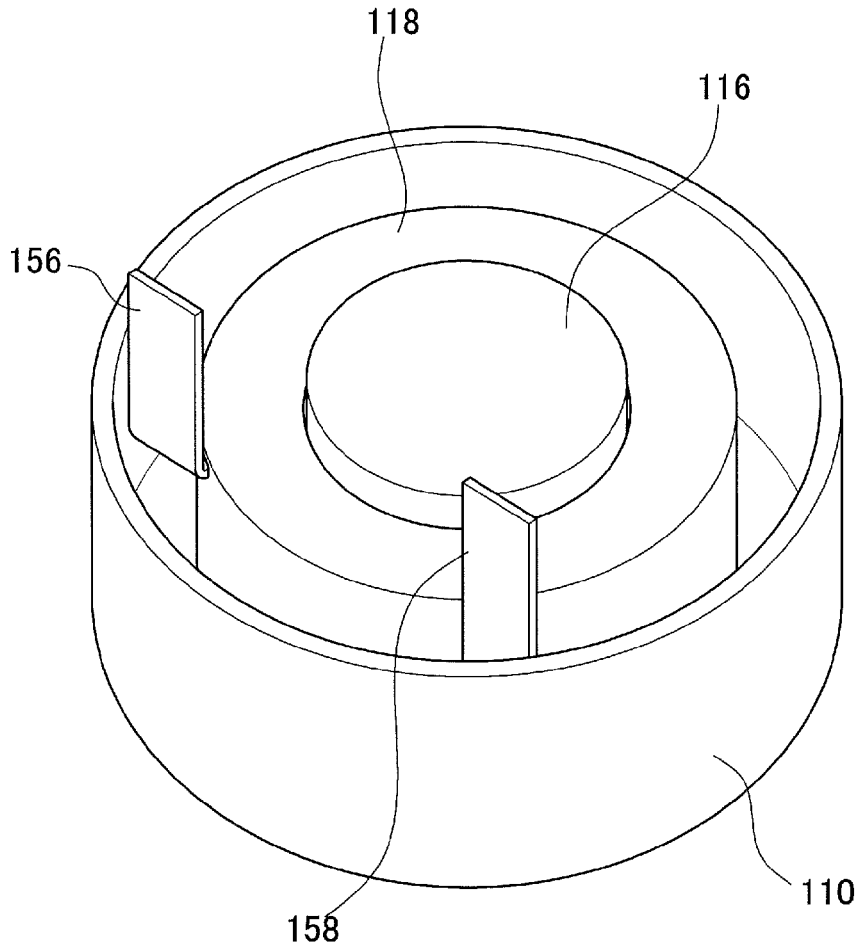
FIG. 6 is an explanatory view showing a state after various components configuring the reactor are assembled in the case and before the case is filled with iron-resin composite.

FIG. 5 is an explanatory view explaining how various components configuring the reactor 101 of this embodiment are assembled into the case 110, as mentioned above. FIG. 6 is an explanatory view showing a state after various components configuring the reactor 101 of this embodiment have been assembled into the case 110 and before the case is filled with the iron-resin composite.

The reactor 101 of this embodiment is manufactured as follows. First, as shown in FIG. 5, the pressed powder core members 112A to 112D and the gap plates 114A to 114C are alternately disposed with the pillar 126 integral with the case 110 being inserted into the through holes 132 and 134 of the pressed powder core members 112A to 112D and the gap plates 114A to 114C. More specifically, the pressed powder core member 112A, gap plate 114A, pressed powder core member 112B, gap plate 114B, pressed powder core member 112C, gap plate 114C, and pressed powder core member 112D are disposed in this order from a side of the bottom part 122 of the case 110.

Thus the cylindrical center core 136 is formed by the plurality of pressed powder core members 112A to 112D stacked upon one another with the gap plates 114A to 114C interposed in between. At this time, the center core 136 is disposed upon the upper face 130 of the seat 128. More particularly, the pressed powder core member 112A, which is the one located closest to the bottom part 122 of the case 110, of the pressed powder core members 112A to 112D forming the center core 136 is disposed upon the upper face 130 of the seat 128, so that the end face 129 of the pressed powder core member 112A comes into contact with the upper face 130 of the seat 128. The pressed powder core member 112A located closest to the bottom part 122 of the case 110 is formed to have an inner peripheral surface 131 with an inside diameter being smaller than an outside diameter of the upper face 130 of the seat 128. Thereby the pressed powder core member 112A can be reliably placed on the upper face 130 of the seat 128.

This arrangement in which the pressed powder core member 112A, which is the one located closest to the bottom part 122 of the case 110 of the pressed powder core members 112A to 112D forming the center core 136, is disposed upon the upper face 130 of the seat 128, determines the axially relative positions of the pressed powder core members 112A to 112D and the gap plates 114A to 114C forming the case 110 and the center core 136. Also, the radially relative positions of the case 110 and the pressed powder core members 112A to 112D can be adjusted within the size range of the gap between the outer peripheral surface 133 of the pillar 126 and the inner peripheral surface 131 of the pressed powder core members 112A to 112D, thereby the pressed powder core members 112A to 112D can be placed at predetermined positions. Also, the radially relative positions of the case 110 and the gap plates 114A to 114C can be adjusted within the size range of the gap between the outer peripheral surface 133 of the pillar 126 and the inner peripheral surface 135 of the gap plates 114A to 114C, thereby the gap plates 114A to 114C can be placed at predetermined positions. Using the pillar 126 and the seat 128 integral with the case 110 in this manner enables disposing the pressed powder core members 112A to 112D and the gap plates 114A to 114C at predetermined positions without increasing the number of components.

Then, as shown in FIG. 5, the bobbin 116 is placed so as to cover the center core 136. At this time, the inner side surface 146 of the end surface 138 of the bobbin 116 comes to contact with the end face 144 of the pressed powder core member 112D located uppermost of the center core 136. Incidentally, a space is provided between the inner peripheral surface 148 of the bobbin 116 and the outer peripheral surface 150 of the pressed powder core members 112A to 112D.

Next, the coil assembly 118 is disposed radially outside the outer peripheral surface 149 of the bobbin 116 such that the bobbin 116 is inserted radially inside the inner peripheral surface 160 of the coil assembly 118. At this time, the end face 141 of the coil assembly 118 comes to contact with the flange 142 of the bobbin 116.

Next, the iron-resin composite in a molten state is poured into the case 110 and the case 110 is placed in a heating furnace (not shown) and heated at a predetermined temperature for a predetermined period of time to set the iron-resin composite to form the resin core 120. Thereby, the center core 136, the bobbin 116, and the coil assembly 118 are sealed with the resin core 120.

The reactor 101 is manufactured as described above.

According to the method of manufacturing the reactor 101 in this embodiment, the pillar 126 is inserted in the through holes 132 and 134 of the pressed powder core members 112A to 112D and the gap plates 114A to 114C, so that the pressed powder core members 112A to 112D and the gap plates 114A to 114C can be easily mounted on the case 110, as adjusting the radially relative positions of the case 110 and the pressed powder core members 112A to 112D and the radially relative positions of the case 110 and the gap plates 114A to 114C. Thus the productivity of the reactor 101 is enhanced.

The end face 129 of the pressed powder core member 112A is brought into contact with the seat 128 and the pressed powder core members 112B to 112D are placed above the pressed powder core member 112A, so that the axially relative positions of the case 110 and the pressed powder core members 112A to 112D are decided. Therefore, the pressed powder core members 112A to 112D can be placed at predetermined positions without increasing number of components.

Further, the inner side surface 146 of the end surface 138 of the bobbin 116 is brought into contact with the end face 144 of the pressed powder core member 112D placed uppermost of the center core 136, so that the axially relative positions of the pressed powder core members 112A to 112D, the gap plates 114A to 114C, and the bobbin 116 are decided. Therefore, the bobbin 116 can be placed at a predetermined position.

The end face 141 of the coil assembly 118 is brought into contact with the flange 142 of the bobbin 116, so that the axially relative positions of the bobbin 116 and the coil assembly 118 are decided. Therefore, the coil assembly 118 can be placed at a predetermined position while the iron-resin composite is filled and set in the case 110.

Further, own weight of the coil assembly 118 acts on the pressed powder core members 112A to 112D via the bobbin 116. Thereby, float and misalignment of the pressed powder core members 112A to 112D can be prevented and the pressed powder core members 112A to 112D can be placed at predetermined positions while the iron-resin composite is filled and set in the case 110.

Since the non-magnetic ring-shaped gap plates 114 are provided between the adjacent pressed powder core members 112, inductance can be adjusted by varying thickness or number of the gap plates 114. Thereby, stable DC superimposition characteristics can be obtained as the inductance is almost at a fixed value (flat) within the used current range, thus enhancing the performance of the reactor 101.

Moreover, the iron-resin composite in a molten state poured into the case 110 after the various components have been placed also takes a role as the adhesive for the various parts, so that a step of bonding the pressed powder core members 112A to 112D and the gap plates 114A to 114C together with adhesive can be omitted.

Figure 7:
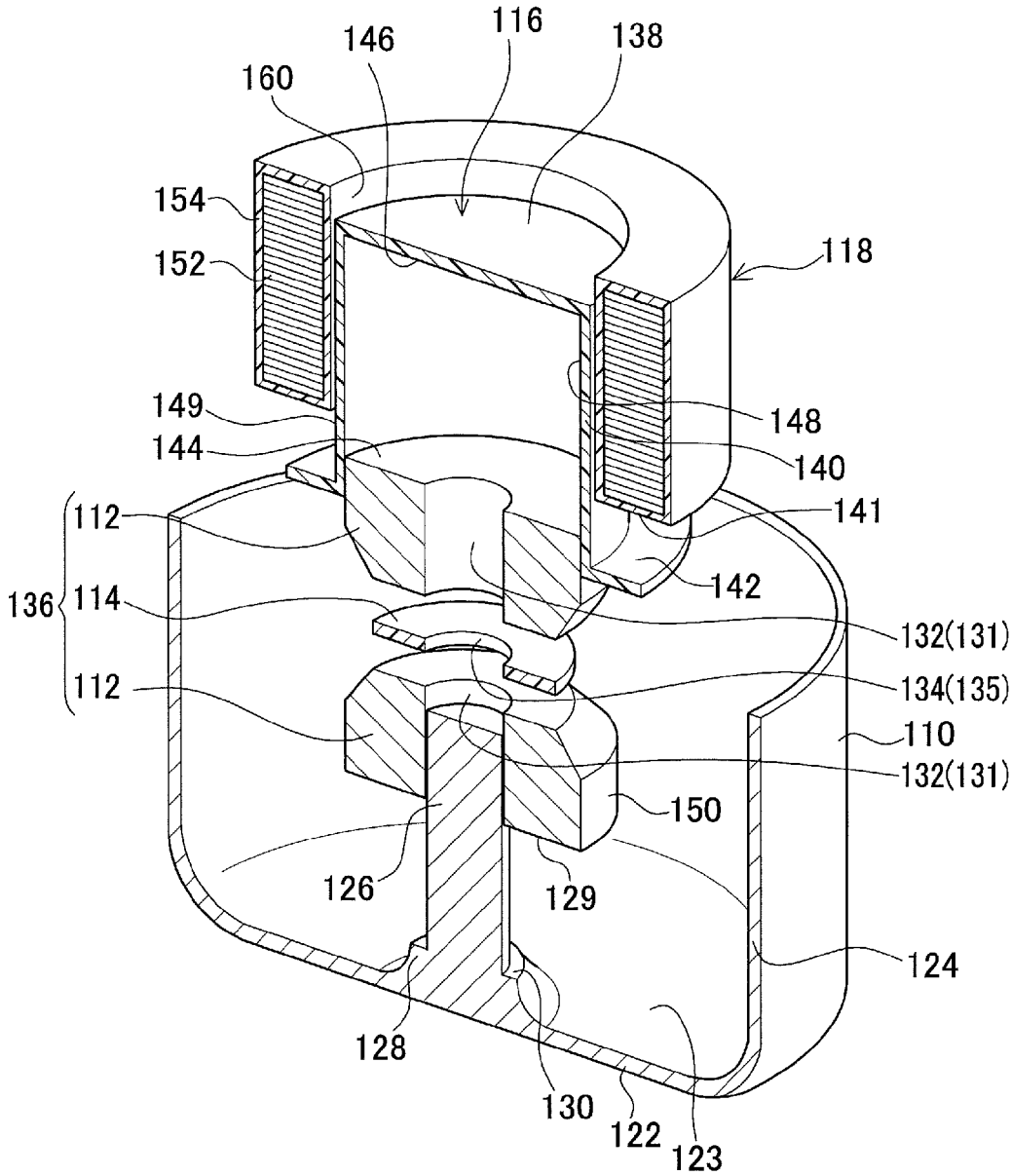
FIG. 7 is a view showing another embodiment in which the numbers of pressed powder core members and gap plates are changed.

The numbers of the pressed powder core members 112 and the gap plates 114 are not limited to particular ones. There could be an example where two pressed powder core members 112 and one gap plate 114 are provided, as shown in FIG. 7.

Embodiment 2

Figure 8:
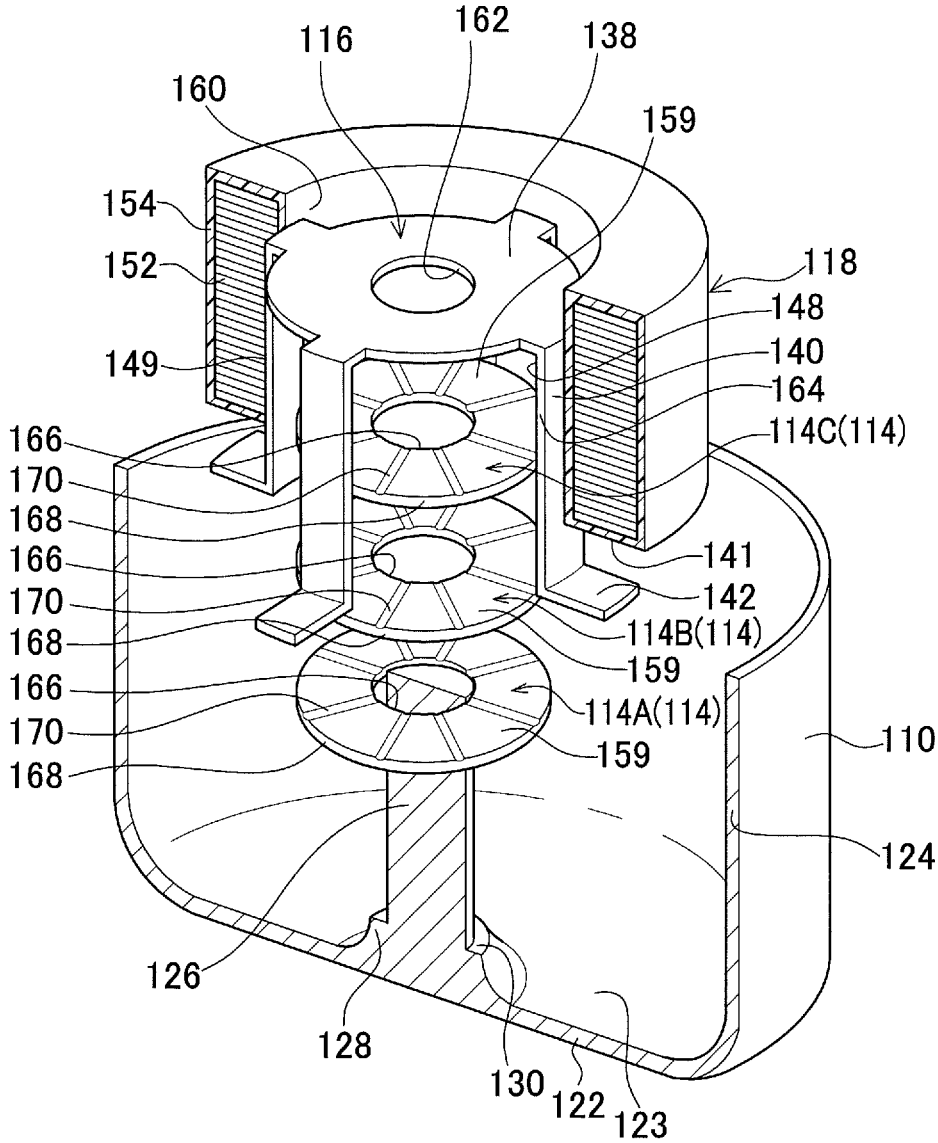
FIG. 8 is an explanatory view showing how various components configuring the reactor are assembled in the case in the second embodiment.

FIG. 8 is an explanatory view showing how various components configuring the reactor 102 are assembled in the case 110 in Embodiment 2. The outer shape of the reactor 102 in Embodiment 2 is similar to that of Embodiment 1 as shown in FIG. 3. In FIG. 8, the pressed powder core members 112 are not shown for convenience in explanation. Further, same or similar elements as Embodiment 1 will be given the same reference numerals and not described again, and different point will be mainly explained in the following description.

The reactor 102 in Embodiment 2 has the different configuration from the reactor 101 in Embodiment 1 that the bobbin 116 is formed with an opening 162 on the end surface 138 in the axial direction and openings 164 on a side wall 140. According to an example shown in FIG. 8, the opening 162 of circular shape is formed at a center portion of the end surface 138, and four openings 164 are formed along an outer periphery of the end surface 138. However, position and shape of the openings 162 and 164 are not limited to the ones shown in FIG. 8. An opening may be provided on either one of the end surface 138 or the side wall 140.

According to the reactor 102 in Embodiment 2, when the iron-resin composite in a molten state is filled inside the case 110 after various components are mounted, the iron-resin composite flows radially inside the inner peripheral surface 148 of the bobbin 116 from the openings 162 and 164. Thus, the pressed powder core members 112 and the gap plates 114 are securely bonded by setting the flowing iron-resin composite.

Also as shown in FIG. 8, the gap plates 114 have slits 170 radially extending from inner peripheral surfaces 166 to outer peripheral surfaces 168 on axial end faces 159. Thereby, the iron-resin composite flowing radially inside the inner peripheral surface 148 of the bobbin 116 further flows into the space between the pressed powder core members 112 and the gap plates 114 via the slits 170. Accordingly, the pressed powder core members 112 and the gap plates 114 are further securely bonded by setting the iron-resin composite flowing into the space between the pressed powder core members 112 and the gap plates 114 via the slits 170.

The above mentioned embodiments are merely examples, not limiting the invention. The present invention may be embodied in other specific forms without departing from the essential characteristics thereof.

The plurality of pressed core members 112 are provided in the above examples. Alternately, a reactor provided with a single pressed core member 112 may be adopted.

REFERENCE SIGNS LIST

1 Drive control system
10 PCU
12 Motor generator
14 Battery
101 Reactor
102 Reactor
110 Case
112 Pressed powder core member
114 Gap plate
116 Bobbin
118 Coil assembly
120 Resin core
126 Pillar
128 Seat
136 Center core
142 Flange
162 Opening
164 Opening
170 Slit

The invention claimed is:

1. Reactor having a case and a cylindrical coil assembly stored in the case and formed to have a coil covered with resin, an iron-resin composite containing iron powder for sealing the coil assembly, wherein the reactor comprises a pillar integrally formed with the case and one or a plurality of ring-shaped core members, the ring-shaped core member or members are provided outside an outer peripheral surface of the pillar such that the pillar is inserted inside an inner peripheral surface of the ring-shaped core member or members, the coil assembly is provided outside an outer peripheral surface of the ring-shaped core member or members such that the ring-shaped core member or members are inserted inside an inner peripheral surface of the coil assembly, and the ring-shaped core member or members are sealed with the iron-resin composite, the reactor includes a bobbin having an opening formed with an end surface and a side wall extending vertically from a peripheral edge of the end surface, the bobbin is provided inside an inner peripheral surface of the coil assembly so as to cover the ring-shaped core member or members, the bobbin has a flange on an opening end portion of the bobbin, and an axial end face of the coil assembly is in contact with the flange.

2. The reactor according to claim 1, wherein the reactor includes a seat formed between the pillar and the case, the seat having a larger diameter than that of the pillar, and an axial end face of the ring-shaped core member or members is in contact with the seat.

3. The reactor according to claim 1, wherein the bobbin has an opening on at least one of the end surface and the side wall.

4. The reactor according to claim 1, wherein the reactor has a non-magnetic gap plate formed into a ring-like shape, and the gap plate is provided in between the adjacent ring-shaped core members.

5. The reactor according to claim 4, wherein the gap plate has a slit extending from an inner peripheral surface to an outer peripheral surface of an axial end face of the gap plate.

6. A method of manufacturing a reactor including a case and a cylindrical coil assembly stored inside the case and formed to have a coil covered with resin, an iron-resin composite containing iron powder for sealing the coil assembly, wherein the reactor comprises a pillar integrally formed with the case and one or a plurality of ring-shaped core member or members, the method includes:

placing the ring-shaped core member or members outside an outer peripheral surface of the pillar such that the pillar is inserted inside an inner peripheral surface of the ring-shaped core member or members;

covering the ring-shaped core member or members inside an inner peripheral surface of the coil assembly with a bobbin having an opening formed with an end surface and a side wall extending vertically from a peripheral edge of the end surface;

placing the coil assembly outside an outer peripheral surface of the bobbin such that the bobbin is inserted inside an inner peripheral surface of the coil assembly;

bringing an axial end face of the coil assembly into contact with a flange formed on an opening end portion of the bobbin, and sealing the ring-shaped core member or members with the iron-resin composite.

7. The reactor manufacturing method according to claim 6, wherein the method comprises the step of bringing a seat into contact with an axial end face of the ring-shaped core member or members, the seat being formed between the pillar and the case and having a larger diameter than that of the pillar.

8. The reactor manufacturing method according to claim 6, wherein the bobbin has an opening on at least one of the end surface and the side wall.

9. The reactor manufacturing method according to claim 6, wherein a non-magnetic gap plate formed into a ring-like shape is provided between the adjacent ring-shaped core members.

10. The reactor manufacturing method according to claim 9, wherein the gap plate has a slit extending from an inner peripheral surface to an outer peripheral surface on an axial end face of the gap plate.

11. The reactor according to claim 2, wherein the bobbin has an opening on at least one of the end surface and the side wall.

12. The reactor according to claim 2, wherein the reactor has a non-magnetic gap plate, and the gap plate is provided in between the adjacent ring-shaped core members.

13. The reactor according to claim 3, wherein the reactor has a non-magnetic gap plate, and the gap plate is provided in between the adjacent ring-shaped core members.

14. The reactor according to claim 11, wherein the reactor has a non-magnetic gap plate, and the gap plate is provided in between the adjacent ring-shaped core members.

15. The reactor according to claim 12, wherein the gap plate has a slit extending from an inner peripheral surface to an outer peripheral surface of an axial end face of the gap plate.

16. The reactor according to claim 13, wherein the gap plate has a slit extending from an inner peripheral surface to an outer peripheral surface of an axial end face of the gap plate.

17. The reactor according to claim 14, wherein the gap plate has a slit extending from an inner peripheral surface to an outer peripheral surface of an axial end face of the gap plate.

* * * * *